US005869228A

United States Patent [19]

Yokozawa

[11] Patent Number: 5,869,228

[45] Date of Patent: Feb. 9, 1999

[54] SILVER HALIDE COLOR PHOTOGRAPHIC LIGHT-SENSITIVE MATERIAL AND METHOD OF FORMING COLOR IMAGE

[75] Inventor: Akito Yokozawa, Kanagawa, Japan

[73] Assignee: Fuji Photo Film Co., Ltd., Minami-ashigara, Japan

[21] Appl. No.: 873,364

[22] Filed: Jun. 12, 1997

[30] Foreign Application Priority Data

Jun. 18, 1996 [JP] Japan ..... 8-157033

[51] Int. Cl.[6] ..... G03C 1/08

[52] U.S. Cl. ..... 430/540; 430/363; 430/604; 430/607

[58] Field of Search ..... 430/540, 567, 430/604, 607

[56] References Cited

U.S. PATENT DOCUMENTS

| | | | |
|---|---|---|---|
| 4,439,520 | 3/1984 | Kofron et al. | 430/434 |
| 4,840,878 | 6/1989 | Hirose et al. | 430/380 |
| 5,204,234 | 4/1993 | Asami | 430/567 |
| 5,208,139 | 5/1993 | Ishigaki | 430/523 |
| 5,227,286 | 7/1993 | Kuno et al. | 430/539 |
| 5,229,263 | 7/1993 | Yoshida et al. | 430/600 |
| 5,391,471 | 2/1995 | Ohshima et al. | 430/523 |
| 5,434,033 | 7/1995 | Kawai | 430/357 |
| 5,484,690 | 1/1996 | Gotto | 430/435 |
| 5,573,901 | 11/1996 | Yamashita et al. | 430/567 |
| 5,631,126 | 5/1997 | Daubendiek et al. | 430/567 |

FOREIGN PATENT DOCUMENTS 132647 6/1991 Japan .

*Primary Examiner*—Hoa Van Le
*Attorney, Agent, or Firm*—Burns, Doane, Swecker & Mathis, LLP

[57] ABSTRACT

A silver halide color photographic light-sensitive material comprising a support having thereon at least one silver halide emulsion layer containing a yellow coupler, at least one silver halide emulsion layer containing a magenta coupler and at least one silver halide emulsion layer containing a cyan coupler, wherein at least one of the silver halide emulsion layers contains (1) silver halide grains having a silver chloride content of 95 mol % or more and containing from $1\times10^{-7}$ to $1\times10^{-3}$ mol of iron ion per mol of the silver halide in a state wherein the concentration of iron ion which is present in a surface region of the silver halide grains which amounts to 50% or less of the grain volume is ten times or more as high as that of other region, and (2) a water-soluble compound represented by the following formula (I):

(I)

the substituents are defined in the specificaton.

The silver halide color photographic light-sensitive material not only has good rapid processing suitability and short exposure suitability, but also is prevented from sensitization and pressure-induced sensitization after preservation thereof for a long period of time before exposure.

12 Claims, No Drawings

SILVER HALIDE COLOR PHOTOGRAPHIC LIGHT-SENSITIVE MATERIAL AND METHOD OF FORMING COLOR IMAGE

FIELD OF INVENTION

The present invention relates to a silver halide color photographic light-sensitive material and a method of forming a color image. More particularly, it relates to a silver halide color photographic light-sensitive material which is excellent in rapid processing suitability and short exposure suitability and which does not suffer from undesirable sensitization and undesirable pressure-induced sensitization that occur when the color photographic light-sensitive material is stored for a long period of time before exposure, and a method of forming a color image using the same.

BACKGROUND OF THE INVENTION

Color photography has been popularized and color photographs are obtainable more rapidly and easily in any place owing to the great progress of photographic light-sensitive materials per se and development processing technology. For instance, with respect to color prints using silver halide color photographic light-sensitive materials, advance in a centralized processing system in a production point called a color processing laboratory provided with high-speed printers and large-size processing machines for mass production or a divided processing system in a shop in which a small-size printer processor named a mini lab is furnished makes it possible to produce a large amount of color prints corresponding to various needs. However, it is still desired to produce a large amount of color prints more rapidly and more simply.

Regarding rapid processing, a technique of processing a color photographic light-sensitive material containing a silver halide emulsion having a high silver chloride content with a color developer containing substantially no sulfite ion and benzyl alcohol is disclosed in U.S. Pat. No. 4,840,878. As to short exposure, a technique for obtaining a silver halide photographic light-sensitive material suitable for short exposure with light of high illumination intensity by incorporating iron ions concentratively into a surface region of silver halide grain having a high silver chloride content excellent in the rapid processing suitability is disclosed in JP-A-3-132647 (the term "JP-A" as used herein means an "unexamined published Japanese patent application"). Using this technique, not only the reduction of development processing time but also the reduction of exposure time can be achieved.

In addition to the shortening of time for the production of color prints, stabilization of qualities of color prints obtained has been always required in order to increase production efficiency. For such a purpose, stability of characteristics of silver halide light-sensitive materials used for the production of color prints is first important. When the characteristics of silver halide light-sensitive materials for color prints are stable, operation of high-speed printer can be performed under constant printing conditions, and thus the production efficiency increases in the color processing laboratory. Also, the stability of characteristics of silver halide light-sensitive materials for color prints often connects directly with the qualities and yield of prints obtained, since it is not easy to secure a skilled operator for the mini lab in the shop.

The inventor has been investigated the technique disclosed in JP-A-3-132647 described above in order to obtain a silver halide photographic light-sensitive material suitable for short exposure. As a result, it is found that the silver halide photographic light-sensitive material has high sensitivity and hard gradation and is hardly desensitized when pressure is applied to the unexposed silver halide photographic light-sensitive material as described in JP-A-3-132647. However, when the silver halide photographic light-sensitive material is stored for a long period of time before exposure, undesirable sensitization occurs and when the unexposed silver halide photographic light-sensitive material stored for a long period of time undergo pressure, desensitization does not take place but sensitization occurs.

SUMMARY OF THE INVENTION

Therefore, an object of the present invention is to provide a silver halide color photographic light-sensitive material which is excellent in rapid processing suitability and short exposure suitability and which does not suffer from undesirable sensitization and undesirable pressure-induced sensitization that occur when-the color photographic light-sensitive material is stored for a long period of time before exposure.

Other objects of the present invention will become apparent from the following detailed description and examples.

The above described objects of the present invention are accomplished with a silver halide color photographic light-sensitive material comprising a support having thereon at least one silver halide emulsion layer containing a yellow coupler, at least one silver halide emulsion layer containing a magenta coupler and at least one silver halide emulsion layer containing a cyan coupler, wherein at least one of the silver halide emulsion layers contains (1) silver halide grains having a silver chloride content of 95 mol % or more and containing from $1\times10^{-7}$ to $1\times10^{-3}$ mol of iron ion per mol of the silver halide in a state wherein the concentration (localization) of iron ion which is present in a surface region of the silver halide grains which amounts to 50% or less of the grain volume is ten times or more as high as that of other region, and (2) a water-soluble compound represented by the following formula (I):

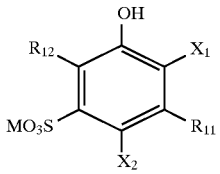

(I)

wherein $X_1$ and $X_2$, which may be the same or different, each represents a hydrogen atom, a hydroxyl group, a halogen atom, a sulfonic acid group or a salt thereof, a carboxylic acid group or a salt thereof, —$NR_{13}R_{14}$ or —$NHSO_2R_{15}$, provided that at least one of $X_1$ and $X_2$ is a hydroxyl group; $R_{11}$ and $R_{12}$, which may be the same or different, each represents a hydrogen atom or a substituent; M represents a hydrogen atom or a monovalent alkali metal; $R_{13}$ and $R_{14}$, which may be the same or different, each represents a hydrogen atom, an alkyl group, an aryl group or a heterocyclic group, or $R_{13}$ and $R_{14}$ may combine with each other to form a heterocyclic ring; and $R_{15}$ represents an alkyl group, an aryl group, an amino group or a heterocyclic group.

The present invention also provides a method of forming a color image comprising subjecting the silver halide color photographic light-sensitive material described above to scanning exposure and then to color development, wherein the method contains the following steps (1) and (2);

step (1): transporting the light-sensitive material in the sub-direction of scanning exposure when it is scanning-exposed, and step (2): transporting the light-sensitive material in the direction opposite to step (1) before the color development (the term "before the color development" includes before the scanning exposure).

DETAILED DESCRIPTION OF THE INVENTION

The water-soluble compound represented by the formula (I) will be described in greater detail below.

In the formula (I), either $X_1$ or $X_2$ is always a hydroxyl group and preferably $X_1$ is a hydroxyl group. When $X_1$ is a hydroxyl group, $X_2$ is preferably a hydrogen atom, —$NR_{13}R_{14}$ or —$NHSO_2R_{15}$. When $X_2$ is a hydroxyl group, $X_1$ is preferably a hydrogen atom, a sulfonic acid group or a salt thereof, or a carboxylic acid group or a salt thereof. $R_{11}$ and $R_{12}$ each is preferably a hydrogen atom, a sulfonic acid group or a salt thereof, a carboxylic acid group or a salt thereof, an alkyl group, an aryl group, an alkoxy group, an aryloxy group or an amino group, and these groups may further be substituted with an appropriate substituent. More preferably, $R_{11}$ is a sulfonic acid group or a salt thereof.

Suitable examples of the substituent include an alkyl group (preferably having from 1 to 20 carbon atoms, e.g., methyl, ethyl, octyl, hexadecyl, or t-butyl), an aryl group (preferably having from 6 to 20 carbon atoms, e.g., phenyl, or p-tolyl), an amino group (preferably having from 0 to 20 carbon atoms, e.g., amino, diethylamino, diphenyl-amino, or hexadecylamino), an amido group (preferably having from 1 to 20 carbon atoms, e.g., acetylamino, benzoylamino, octadecanoylamino, or benzenesulfonamido), an alkoxy group (preferably having from 1 to 20 carbon atoms, e.g., methoxy, ethoxy, or hexadecyloxy), an alkylthio group (preferably having from 1 to 20 carbon atoms, e.g., methylthio, butylthio, or octadecylthio), an acyl group (preferably having from 1 to 20 carbon atoms, e.g., acetyl, hexadecanoyl, benzoyl, or benzenesulfonyl), a carbamoyl group (preferably having from 1 to 20 carbon atoms, e.g., carbamoyl, N-hexylcarbamoyl, or N,N-diphenylcarbamoyl), an alkoxycarbonyl group (preferably having from 2 to 20 carbon atoms, e.g., methoxycarbonyl, or octyloxycarbonyl), a hydroxyl group, a halogen atom (e.g., fluorine, chlorine, or bromine), a cyano group, a nitro group, a sulfo group or a carboxy group. These substituents may further be substituted with a substituent (for example, one of those described for $R_{11}$).

$R_{13}$ and $R_{14}$ each represents a hydrogen atom, an alkyl group (preferably having from 1 to 10 carbon atoms, e.g., ethyl, hydroxyethyl, or octyl), an aryl group (preferably having from 6 to 10 carbon atoms, e.g., phenyl, or naphthyl) or a heterocyclic group (preferably having from 3 to 10 carbon atoms, e.g., 2-furyl, or 4-pyridyl), and these groups may be substituted with a substituent (for example, one of those described for $R_{11}$). $R_{13}$ and $R_{14}$ may combine with each other to form a heterocyclic ring (preferably a 5- to 7-membered ring). $R_{15}$ represents an alkyl group (preferably having from 1 to 20 carbon atoms, e.g., ethyl, octyl, or hexadecyl), an aryl group (preferably having from 6 to 20 carbon atoms, e.g., phenyl, p-tolyl, or 4-dodecyloxyphenyl), an amino group (preferably having from 0 to 20 carbon atoms, e.g., N,N-diethylamino, or N,N-diphenylamino) or a heterocyclic group (preferably having from 3 to 20 carbon atoms, e.g., 3-pyridyl, or morpholino), and these groups may be substituted.

In the present invention, the term "water-soluble" used with respect to the compound represented by the formula (I) means that the compound is soluble not less than 0.1 g per 100 ml of water at 25° C. The water-solubility of the compound is preferably not less than 1 g, more preferably not less than 5 g.

Specific examples of the compound represented by the formula (I) which can be used in the present invention are set forth below, but the present invention should not be construed as being limited thereto.

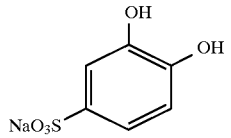

(I)-1

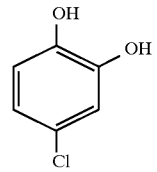

(I)-2

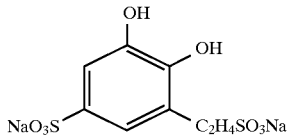

(I)-3

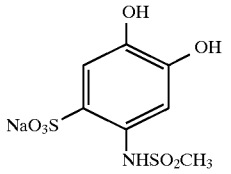

(I)-4

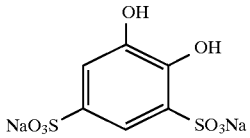

(I)-5

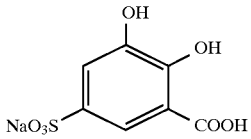

(I)-6

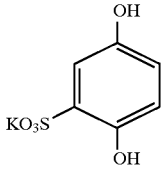

(I)-7

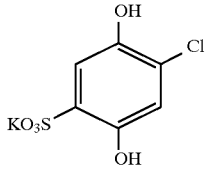

(I)-8

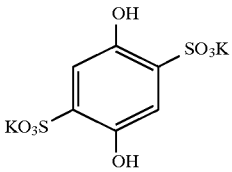

(I)-9

-continued (I)-10

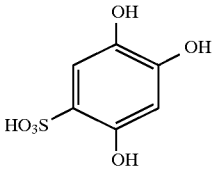

The compound represented by the formula (I) can be synthesized according to known methods. For example, a method of synthesizing Compound (I)-5 shown above is described in the MERCK INDEX Eleventh Edition 9392 (C.A. 48, 5215c (1954)). Specifically, the compound can be prepared by sulfonating catechol by a reaction with fuming sulfuric acid and then neutralizing the reaction product with sodium hydroxide. Also, the compound is commercially available from Aldrich as a catalog number of 17,225-3.

The compound represented by the formula (I) can be incorporated into a light-sensitive layer and/or a light-insensitive layer according to various known methods. For example, a method wherein the compound is directly dispersed in the light-sensitive layer or light-insensitive layer or a method wherein the compound is added to the light-sensitive layer or light-insensitive layer in the form of a solution thereof dissolved in an appropriate solvent (for example, methyl alcohol, ethyl alcohol, propyl alcohol, methyl Cellosolve, a halogenated alcohol described in JP-A-48-9715 or U.S. Pat. No. 3,756,830, acetone, water, pyridine, or a mixture thereof) can be employed. The compound disperses almost uniformly in all photographic constituent layers during the preparation of photographic light-sensitive material even when the compound is incorporated into any of the light-sensitive layer and light-insensitive layer.

The amount of the compound represented by the formula (I) to be used is not particularly limited, and preferably in a range of from $1\times10^{-5}$ g/m$^2$ to 1 g/m$^2$, more preferably in a range of from $1\times10^{-4}$ g/m$^2$ to $1\times10^{-1}$ g/m$^2$.

In the present invention, silver chloride, silver chlorobromide, or silver chloroiodobromide grains having a silver chloride content of 95 mol % or more are used as silver halide grains in at least one sliver halide emulsion layer of the photographic light-sensitive material.

It is preferred that silver chloride or silver chlorobromide grains having a silver chloride content of 95 mol% or more are employed as silver halide grains in all of the light-sensitive silver halide emulsion layers. More preferably, silver chloride or silver chlorobromide grains having a silver chloride content of 98 mol % or more are employed.

In particular, in order to expedite development processing of the photographic light-sensitive material, grains comprising silver chlorobromide or silver chloride substantially free of silver iodide are preferably used in the present invention. The terminology "substantially free of silver iodide" as used herein means that the silver iodide content is 1 mol % or less, preferably 0.2 mol % or less.

The halide composition of the emulsion may be the same or different among grains, however, when the emulsion having the same halide composition among grains is used, it is easy to homogenize the properties of grains.

The silver halide emulsion having a high silver chloride content for use in the present invention preferably has such a structure that a silver bromide localized phase is present inside and/or on the surface of the silver halide grains in the form of a layer or a non-layer. The halide composition of the above described localized phase is preferably such that the silver bromide content is at least 10 mol %, more preferably exceeding 20 mol %. The silver bromide content of the silver bromide localized phases can be analyzed according to the X-ray diffraction method (for example, Shin-Jikken Kagaku Koza 6, Kozo Kaiseki (New Experimental Chemistry Course 6, Analysis of Structure), edited by Nippon Kagaku Kai, published by Maruzen). These localized phases can be present inside the grains, at edges, corners or on planes of the grain surface. One preferred example of the localized phase is that formed by epitaxial growth at the corners of the grains.

Also, it is effective to further increase the silver chloride content of a silver halide emulsion to reduce the replenishing amount of the development processing solution. In such a case, substantially a pure silver chloride emulsion having a silver chloride content of from 98 mol % to 100 mol % is also preferably used.

The silver halide grains contained in the silver halide emulsion for use in the present invention have an average grain size (the grain size herein refers to the diameter of the circle corresponding to the projected area of the grain, and the number average is taken as the average grain size) of preferably from 0.1 $\mu$m to 2 $\mu$m.

With respect to the distribution of sizes of these grains, a so-called monodisperse emulsion having a variation coefficient (the value obtained by dividing the standard deviation of the grain size distribution by the average grain size) of 20% or less, preferably 15% or less, and more preferably 10% or less, is preferred. For obtaining a wide latitude, it is also preferred to blend the above described monodisperse emulsions in one and the same layer or to form a multilayer structure using the monodisperse emulsions.

The silver halide grains contained in the photographic emulsion may have a regular crystal form, such as cubic, tetradecahedral, or octahedral, an irregular crystal form, such as spherical, plate-like, or a composite form of these forms. A mixture of grains having various crystal forms may also be used. In the present invention, the grains having the above described regular crystal forms preferably occupy for 50% or more, more preferably 70% or more, particularly preferably 90% or more.

Further, a silver halide emulsion in which the proportion of tabular grains having an average aspect ratio (diameter of equivalent circle/thickness) of 5 or more, preferably 8 or more, to the entire grains exceeds 50% as a projected area can also be preferably used.

In the present invention, in order to incorporate iron ions into silver halide emulsion grains, it is easy to allow a water-soluble iron compound to be present in the step of forming the emulsion grains. The iron compound is a compound containing a bivalent or trivalent iron ion, and preferably the iron compound is soluble in water in the range of amount used in the present invention. Particularly preferable iron compound is an iron complex salt that can easily be incorporated in the silver halide grains. Specific examples of the ion compound are set forth below, but the present invention should not be construed as being limited thereto: ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ferrous ammonium nitrate, basic ferric acetate, ferric albuminate, ferric ammonium acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidium ferric sulfate, ammonium ferric citrate,potassium hexacyanoferrate(II), potassium pentacyanoammineferrate (II), sodium ethylenedinitrilotetraacetato ferrate(III), potassium hexacyanoferrate(III), iron(III) tris(bipyridyl)chloride, and potassium pentacyanonitrosylferrate(III).

Of these compounds, in particular, a hexacyanoferrate(II), a hexacyanoferrate(III), ferrous thiocyanate, and ferric thiocyanate exhibit a remarkable effect.

The above iron compound is incorporated into the silver halide grains by allowing it to be present in a solution of a dispersion medium (gelatin or a polymer having protective colloid properties), an aqueous solution of the halide, an aqueous solution of the silver salt, or other aqueous solution when the silver halide grains are formed.

In the present invention, the amount of the iron compound to be used is from $10^{-7}$ to $10^{-3}$ mol, more preferably from $10^{-6}$ to $5\times10^{-4}$ mol, per mol of the silver halide.

It is necessary for the iron compound used in the present invention to be contained in a concentrated manner in the surface region that amounts to 50% or less of the grain volume of a silver halide grain. The expression "surface region that amounts to 50% or less of the grain volume" refers to the surface portion corresponding to a volume of 50% or less of the volume of a grain. The volume of the surface region is preferably 40% or less, and more preferably 20% or less. By making the volume of the surface region as small (thin) as possible, the effect of the present invention can be exhibited more remarkably.

In order to cause the effect of the present invention to be exhibited adequately, preferably the portion in which iron ions are contained is limited to the surface region that amounts to 50% or less of the grain volume, though a portion of the iron ions may be contained in core regions of the grains. However, in such a case, it is required that the concentration of iron ions to be contained in the surface region of the grains must be ten times or more as high as that of the core regions of the grains.

In the present invention, metal ions or complex ions thereof other than iron ions may also be incorporated into the silver halide grains. Suitable examples of other metal ions include ions of metals belonging to Group VIII of the Periodic Table such as cobalt, nickel, ruthenium, rhodium, palladium, iridium or platinum. Also, ions of metals such as copper, gold, zinc, cadmium or lead may be incorporated. The metal ions may be incorporated into the region of silver halide grains in which iron ions are contained or the region of silver halide grains in which iron ions are not contained depending on the purposes.

It is preferred that iron ions are used together with iridium ions in the present invention. When the silver halide grains have silver bromide localized phases, a part or all of iridium ions are preferably incorporated into the silver bromide localized phase.

The amount of the metal ions to be incorporated can be varied in a wide range depending on the purposes, and is preferably from $10^{-9}$ to $10^{-2}$ mol per mol of the silver halide.

The above metal ions or complex ions thereof can be incorporated into the silver halide grains and the silver bromide localized phase by adding them to a solution of a dispersion medium (gelatin or a polymer having protective colloid properties), an aqueous solution of the halide, an aqueous solution of the silver salt or other aqueous solution, or by adding as silver halide fine grains containing the metal ions and dissolving the fine grains during the formation of silver halide grains.

In the silver halide color photographic light-sensitive material according to the present invention, other various conventionally known photographic elements and additives can be employed.

For instance, a transmissive type support or reflective type support is used as the photographic support. Among the transmissive type support, a transparent film such as a cellulose triacetate film or a polyethylene terephthalate film, and a polyester film composed of 2,6-naphthalenedicarboxylic acid (NDCA) and ethylene glycol (EG) or composed of NDCA, terephthalic acid and EG having a provided thereon an information recording layer such as a magnetic layer are preferably employed. Of the reflective type supports, a laminate composed of plural water-resistant resin layers such as polyethylene layers or polyester layers and containing a white pigment such as titanium oxide in at least one of the resin layers is preferred.

It is preferred that the water-resistant resin layer contains a fluorescent whitening agent. The fluorescent whitening agent may also be dispersed in a hydrophilic colloid layer of the photographic light-sensitive material. Preferred fluorescent whitening agents used include benzoxazole series, cumarin series and pyrazoline series compounds. Fluorescent whitening agents of benzoxazolyl naphthalene series and benzoxazolyl stilbene series are more preferably used. The amount of the fluorescent whitening agent to be used is not particularly limited and preferably in a range of from 1 to 100 $mg/m^2$. A mixing ratio of the fluorescent whitening agent to be used in the water-resistant resin layer is preferably from 0.0005 to 3% by weight, and more preferably from 0.001 to 0.5% by weight of the resin.

Further, a transmissive type support and a reflective type support each having provided thereon a hydrophilic colloid layer containing a white pigment may be employed.

Moreover, a support having a mirror plate reflective metal surface or a secondary diffusion reflective metal surface may be used as the reflective type support.

In the present invention, the silver halide emulsion is preferably subjected to gold sensitization.

With respect to the reflective type support, silver halide emulsion, stabilizer and antifoggant, chemical sensitization (chemical sensitizer), spectral sensitization (spectral sensitizer), cyan coupler, magenta coupler, yellow coupler, emulsified dispersion method of coupler, color image stabilizer (anti-staining agent, color fading preventing agent), dye (colored layer), gelation, layer construction of photographic material and pH of coated layer, those described in the patents shown in Table 1 are preferably used in the present invention.

TABLE 1

| Photographic Element | JP-A-7-104448 | JP-A-7-77775 | JP-A-7-301895 |
|---|---|---|---|
| Reflective Type Support | Col. 7, line 12 to Col. 12, line 19 | Col. 35, line 43 to Col. 44, line 1 | Col. 5, line 40 to Col. 9, line 26 |
| Sliver Halide Emulsion | Col. 72, line 29 to Col. 74, line 18 | Col. 44, line 36 to Col. 46, line 29 | Col. 77, line 48 to Col. 80, line 28 |

TABLE 1-continued

| Photographic Element | JP-A-7-104448 | JP-A-7-77775 | JP-A-7-301895 |
|---|---|---|---|
| Heterogeneous Metal Ion | Col. 74, lines 19 to 44 | Col. 46, line 30 to Col. 47, line 5 | Col. 80, line 29 to Col. 81, line 6 |
| Stabilizer and Antifoggant | Col. 75, lines 9 to 18 | Col. 47, lines 20 to 29 | Col. 18, line 11 to Col. 31, line 37 (particularly, mercapto hetero-cyclic compound) |
| Chemical Sensitization (Chemical Sensitizer) | Col. 74, line 45 to Col. 75, line 6 | Col. 47, lines 7 to 17 | Col. 81, lines 9 to 17 |
| Spectral Sensitization (Spectral Sensitizer) | Col. 75, line 19 to Col. 76, line 45 | Col. 47, line 30 to Col. 49, line 6 | Col. 81, line 21 to Col. 82, line 48 |
| Cyan Coupler | Col. 12, line 20 to Col. 39, line 49 | Col. 62, lines 50 to Col. 63, line 16 | Col. 88, line 49 to Col. 89, line 16 |
| Yellow Coupler | Col. 87, line 40 to Col. 88, line 3 | Col. 63, lines 17 to 30 | Col. 89, lines 17 to 30 |
| Magenta Coupler | Col. 89, lines 4 to 18 | Col. 63, line 31 to Col. 64, line 11 | Col. 32, line 34 to Col. 77, line 44 and Col. 88, lines 32 to 46 |
| Emulsified Dispersion Method of Coupler | Col. 71, line 8 to Col. 72, line 11 | Col. 61, lines 36 to 49 | Col. 87, lines 35 to 48 |
| Color Image Stabilizer (Anti-staining Agent) | Col. 39, line 50 to Col. 70, line 9 | Col. 61, line 50 to Col. 62, line 49 | Col. 87, line 49 to Col. 88, line 48 |
| Color Fading Preventing Agent | Col. 70, line 10 to Col. 71, line 2 | | |
| Dye (Colored Layer) | Col. 77, line 42 to Col. 78, line 41 | Col. 7, line 14 to Col. 19, line 42 and Col. 50, line 3 to Col. 51, line 14 | Col. 9, line 27 to Col. 18, line 10 |
| Gelatin | Col. 78, lines 42 to 48 | Col. 51, lines 15 to 20 | Col. 83, lines 13 to 19 |
| Layer Construction of Photographic Material | Col. 39, lines 11 to 26 | Col. 44, lines 2 to 35 | Col. 31, line 38 to Col. 32, line 33 |
| pH of Coated Layer | Col. 72, lines 12 to 28 | | |
| Scanning Exposure | Col. 76, line 6 to Col. 77, line 41 | Col. 49, line 7 to Col. 50, line 2 | Col. 82, line 49 to Col. 83, line 12 |
| Preservative in Developing Solution | Col. 88, line 19 to Col. 89, line 22 | | |

The cyan couplers, magenta couplers and yellow couplers which can be suitably employed in the present invention also include those described in JP-A-62-215272, page 91, right upper column, line 4 to page 121, left upper column, line 6, JP-A-2-33144, page 3, right upper column, line 14 to page 18, left upper column, last line and page 30, right upper column, line 6 to page 35, right lower column, line 11, and EP-A-355660, page 4, lines 15 to 27, page 5, line 30 to page 28, last line, page 45, lines 29 to 31 and page 47, line 23 to page 63, line 50.

The bactericides and anti-mold agents described in JP-A-63-271247 are suitably used in the present invention.

The silver halide photographic light-sensitive material according to the present invention is suitable for a scanning exposure system using a cathode ray tube (CRT) in addition to a conventional printing system using a negative printer.

An exposure device-using a cathode ray tube is simple, compact and low-cost in comparison with an exposure device using a laser beam. Also, the former is advantageous in view of easy control of an optical axis and color.

In the cathode ray tube used for the image exposure, various light emitting materials which emit light in the visible spectra are employed depending on the demand. For instance, a red light emitting material, a green light emitting material and a blue light emitting material are used individually or in a combination of two or more thereof. The light emitting materials are not limited to those of red, green and blue described above, and other light emitting materials which emit yellow light, orange light, purple light or infrared light may also be utilized. Particularly, a cathode ray tube using a combination of these light emitting materials to emit white light is frequently employed.

When the photographic light-sensitive material having a plural of light-sensitive layers each having a different spectral sensitivity and the cathode ray tube having a plural of light emitting materials each emitting light having a different spectrum are used, a plural of color image signals are input to the cathode ray tube to emit the respective light and a plural of colors are exposed at once. Alternatively, a successive exposure method wherein each color light is emitted according to the input of the corresponding image signal, in order, and filters which cut color light other than the desired color light are used can be adopted. In general, the successive exposure method is preferred to obtain high quality images, since a cathode ray tube of high resolving power can be used.

The photographic light-sensitive material of the present invention can preferably be used in digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum of the photographic light-sensitive material of the present invention can be appropriately set according to the wavelength of the scanning exposure light source to be used. As an oscillation wavelength of a laser can be made half using an SHG light source comprising a combination of non-linear optical crystal with a solid state laser using a semiconductor laser as an excitation light source or a semiconductor laser, blue light and green light can be obtained. Accordingly, it is possible to have the spectral sensitivity maximum of the photographic light-sensitive material in normal three regions of blue, green and red.

The exposure time in the scanning exposure is defined as the time necessary to expose the pixel size with the pixel density being 400 dpi, and preferred exposure time is $10^{-4}$ second or less and more preferably $10^{-6}$ second or less.

Preferred scanning exposure systems suitable for use in the present invention are described in detail in the patents set forth in the table shown above.

In order to process the silver halide photographic light-sensitive material of the present invention, processing elements and processing methods described in JP-A-2-207250, page 26, right lower column, line 1 to page 34, right upper column, line 9 and JP-A-4-97355, page 5, left upper column, line 17 to page 18, right lower column, line 20 are preferably employed. As preservatives in developing solution, the compounds described in the patent set forth in the table shown above are preferably employed.

In order to conduct development processing of the photographic light-sensitive material according to the present invention after imagewise exposure, a wet type developing process, for example, a developing method using a conventional developing solution containing an alkaline agent and a developing agent, and an activator method in which a photographic light-sensitive material containing a developing agent is developed with an activator solution such as an alkaline solution containing no developing agent, as well as a dry type developing process without using a processing solution, for example, a heat developing method can be employed.

The wet type developing process includes a developing method using a conventional developing solution containing an alkaline agent and a developing agent, and an activator method in which a photographic light-sensitive material containing a developing agent is developed with an activator solution such as an alkaline solution containing no developing agent. Particularly, the activator method is preferred since the processing solution does not contain a developing agent, thus the control and handling of the processing solution are easy. Also, it is favorable in view of the environmental conservation since a load for treatment of the waste solution is small.

The developing agents and precursors thereof which can be incorporated into the photographic light-sensitive material used in the activator method are preferably hydrazine series compounds described, for example, in Japanese Patent Application Nos. 7-334190, 7-334192, 7-334197 and 7-344396, and JP-A-8-234388.

Further, a developing method wherein the photographic light-sensitive material having a reduced coating amount of silver is subjected to an image amplification process (intensification process) using hydrogen peroxide is preferably employed. In particular, it is preferred to apply this method to the activator method. Specifically, an image forming method using the activator solution containing hydrogen peroxide as described in Japanese Patent Application Nos. 7-63587 and 7-334202 is preferably employed.

According to the activator method, the photographic material is ordinarily subjected to a desilvering treatment after the treatment with the activator solution. However, in the image amplification process using the photographic material having a reduced coating amount of silver, the desilvering treatment is omitted and a simple treatment such as washing with water or stabilizing treatment is conducted. Further, in a system wherein an image information is read from a photographic material by a scanner, the processing method omitting the desilvering treatment can be adopted, even when a photographic light-sensitive material having a large coating amount of silver such as a photographic light-sensitive material for photographing is processed.

Processing elements-and processing methods for the activator treatment, desilvering (bleaching/fixing), water washing and stabilizing used in the present invention include those known in the art. Preferably, those described in *Research Disclosure*, September 1994, Item 36544, pages 536 to 541 and JP-A-8-234388 are employed.

In the image forming method according to the present invention, digital photographic printers described in JP-A-8-16238, pages 5 to 12 and FIGS. 1 to 2 are preferably employed as apparatus for conducting reading of image information, exposure and processing.

In a image recording portion, it is necessary to start transportation of the photographic light-sensitive material before the start of scanning exposure and to maintain the constant speed of transportation in order to keep the definite pitch of scanning exposure. The distance of transportation before the start of scanning exposure may be varied depending on ability of a motor for driving rollers and is preferably in a range of from 10 mm to 100 mm in the present invention. In such a case, the transported portion of the photographic light-sensitive material is formed which results in loss of the photographic material wherever the scanning exposure is interrupted. For preventing such a loss, it is preferred to conduct a step of transporting the photographic light-sensitive material in the opposite direction at the definite distance when the scanning exposure is interrupted. The distance of transportation in the opposite direction is preferably in a range of from 10 mm to 100 mm.

The silver halide color photographic light-sensitive material according to the present invention is excellent in rapid processing suitability and short exposure suitability and does not suffer from the undesirable sensitization and the undesirable pressure-induced sensitization, which occur when it is stored for a long period of time before exposure.

The present invention will be explained in greater detail with reference to the following examples, but the present invention should not be construed as being limited thereto.

EXAMPLE 1

6.0 g of sodium chloride was added to a 3% aqueous solution of lime-treated gelatin, and then 2.9 ml of N,N-dimethylimidazolidine-2-thion (1% aqueous solution) was added thereto to prepare Solution I. To Solution I were added an aqueous solution containing 0.2 mol of silver nitrate (Solution II) and an aqueous solution containing 0.02 mol of potassium bromide and 0.18 mol of sodium chloride (Solution III) at 50° C. with vigorous stirring to mix them. Then, an aqueous solution containing 0.8 mol of silver nitrate (Solution IV) and an aqueous solution containing 0.08 mol of potassium bromide and 0.72 mol of sodium chloride (Solution V) were added at 50° C. with vigorous stirring to mix them. Further, potassium ferrocyanide and potassium hexachloroiridate(IV) were added to Solution III and Solution V to incorporate uniformly into the resulting silver halide grains in an amount of $6.0\times10^{-5}$ mol and $5.0\times10^{-8}$ mol, respectively, per mol of the silver halide. After maintaining the mixture at 50° C. for 20 minutes, the temperature was lowered and desalting and washing with water were conducted. Then, 160 g of lime-treated gelatin was added, and after adjusting the pH and pAg, triethyl thiourea was added to perform optimal sulfur sensitization.

The green-sensitive Sensitizing Dyes D, E and F shown below were added in an amount of $3.5\times10^{-4}$ mol, $5.0\times10^{-5}$ mol and $1.0\times10^{-4}$ mol, respectively per mol of the silver halide to conduct spectral sensitization. The resulting green-sensitive silver chlorobromide emulsion was designated Emulsion M-1.

Sensitizing Dyes for Green-Sensitive Emulsion Layer:

Sensitizing Dye D

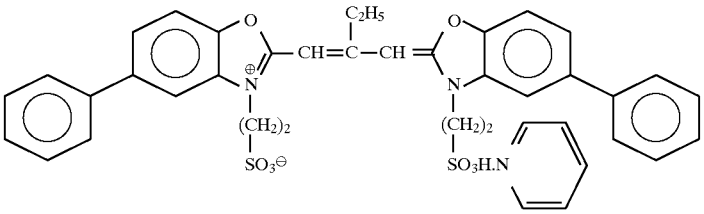

Sensitizing Dye E

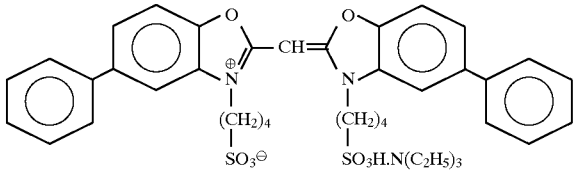

Sensitizing Dye F

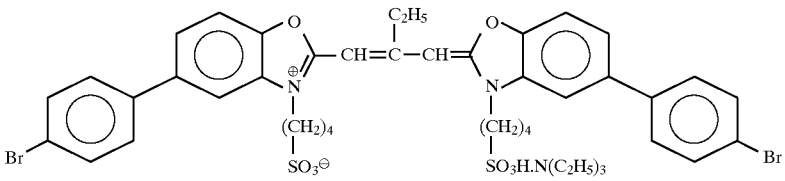

In the preparation of Emulsion M-1, Solution IV was divided into two parts at the various ratios to prepare Solution IV-1 and Solution IV-2, and Solution V was divided into two parts at the same ratio as for Solution IV to prepare Solution V-1 and Solution V-2. In place of the addition of Solution IV and Solution V, Solution IV-1 and Solution V-1 were added and subsequently Solution IV-2 and Solution V-2 were added. Further, the amounts of potassium ferrocyanide and potassium hexachloroiridate(IV) added to Solution III, Solution V-1 and Solution V-2 were variously changed. Silver chlorobromide emulsions designated Emulsion M-2 to M-7 were prepared in the same manner as-in Emulsion M-1 except for the above modifications.

In the same manner as in the preparation of Emulsion M-7 except for using the equimolar amount of sodium chloride instead of potassium bromide in Solution III, Solution V-1 and Solution V-2 to prepare a pure silver chloride emulsion designated Emulsion M-8. On the surface of emulsion grains of pure silver chloride emulsion prepared in the same manner as in Emulsion M-8 was formed silver bromide localized phases to prepare a silver chlorobromide emulsion designated Emulsion M-9. In the same manner as in the preparation of Emulsion M-9 except for changing variously the amounts of potassium hexa-chloroiridate(IV) added to Solution III, Solution V-1 and Solution V-2 and incorporating potassium hexachloroiridate(IV) into the silver bromide localized phases to prepare silver chlorobromide emulsions designated Emulsion M-10 and Emulsion M-11.

The halogen compositions, the grain sizes, the amounts of metal ions contained and the positions of the regions of the grains where the metal ions were contained in these green-sensitive silver halide emulsions are shown in Table 2-1 below.

The procedures described for the green-sensitive silver halide emulsions designated Emulsions M-1 to M-11 were repeated except that the temperature at the time when the silver halide grains were formed was changed to alter the grain size, the amounts of metal ions contained in Solution III, Solution V-1, Solution V-2 and/or the silver bromide localized phases were changed and the blue-sensitive Sensitizing Dyes A, B and C shown below were added in an amount of $2.4\times10^{-4}$ mol, $1.2\times10^{-4}$ mol and $1.8\times10^{-4}$ mol, respectively, per mol of the silver halide in place of the green-sensitive sensitizing dyes to conduct spectral sensitization to prepare blue-sensitive silver halide emulsions designated Emulsions Y-1 to Y-8. Further, red-sensitive silver halide emulsions designated Emulsions C-1 to C-8 were prepared in the same manner as described above except that the red-sensitive Sensitizing Dye G was added in an amount of $5.0\times10^{-5}$ per mol of silver halide instead of the blue-sensitive sensitizing dyes to conduct spectral sensitization.

Sensitizing Dyes for Blue-Sensitive Emulsion Layer:

Sensitizing Dye A

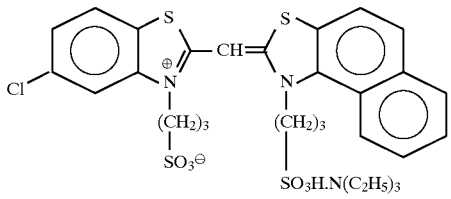

Sensitizing Dye B

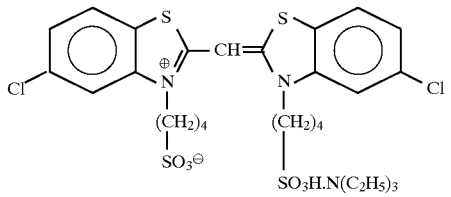

Sensitizing Dye C

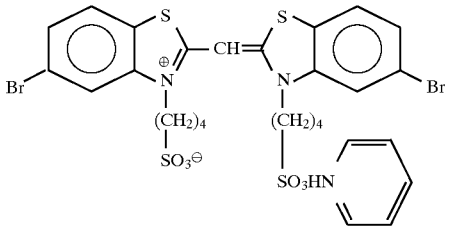

Sensitizing Dyes for Red-Sensitive Emulsion Layer:

Sensitizing Dye G

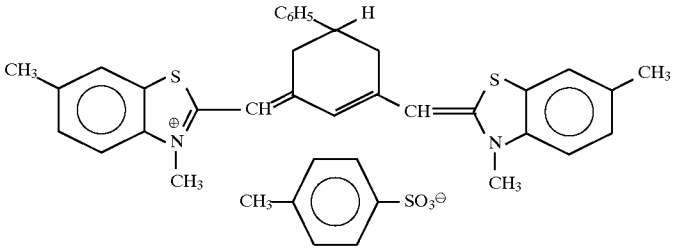

The halogen compositions, the grain sizes, the amounts of metal ions contained and the positions of the regions of the grains where the metal ions were contained in these blue-sensitive silver halide emulsions and red-sensitive silver halide emulsions are also shown in Table 2-2 and Table 2-3 below, respectively.

TABLE 2-1

Green-Sensitive Emulsion

| Emulsion | Halogen Composition | Grain Size | Variation Coefficient of Grain Size Distribution | Shape of Grain | Silver Bromide Localized Phase | Iron Ions (mol/mol Ag) | Region containing Iron Ions in Grain | Iridium Ions (mol/mol Ag) | Region containing Iridium Ions in Grain |
|---|---|---|---|---|---|---|---|---|---|
| M-1 | Cl 99 mol % (Br 1 mol %) | 0.50μ | 0.07 | cubic | None | $6 \times 10^{-5}$ | Uniformly contained in grain | $5 \times 10^{-8}$ | Uniformly contained in grain |
| M-2 | Cl 99 mol % (Br 1 mol %) | 0.51μ | 0.08 | cubic | None | $6 \times 10^{-5}$ | Uniformyl contained in grain | $5 \times 10^{-8}$ | Surface region of 50% |
| M-3 | Cl 99 mol % (Br 1 mol %) | 0.50μ | 0.07 | cubic | None | $6 \times 10^{-5}$ | Uniformly contained in grain | $5 \times 10^{-8}$ | Surface region of 20% |
| M-4 | Cl 99 mol % (Br 1 mol %) | 0.50μ | 0.07 | cubic | None | $6 \times 10^{-5}$ | 92% in surface region of 50% and 8% in other region | $5 \times 10^{-8}$ | Surface region of 20% |
| M-5 | Cl 99 mol % (Br 1 mol %) | 0.50μ | 0.08 | cubic | None | $6 \times 10^{-5}$ | Surface region of 50% | $5 \times 10^{-8}$ | Surface region of 20% |
| M-6 | Cl 99 mol % (Br 1 mol %) | 0.50μ | 0.07 | cubic | None | $6 \times 10^{-5}$ | Surface region of 40% | $5 \times 10^{-8}$ | Surface region of 20% |
| M-7 | Cl 99 mol % (Br 1 mol %) | 0.50μ | 0.07 | cubic | None | $6 \times 10^{-5}$ | Surface region of 20% | $5 \times 10^{-8}$ | Surface region of 20% |
| M-8 | Cl 100 mol % | 0.51μ | 0.07 | cubic | None | $6 \times 10^{-5}$ | Surface region of 20% | $5 \times 10^{-8}$ | Surface region of 20% |
| M-9 | Cl 99 mol % (Br 1 mol %)* | 0.50μ | 0.07 | cubic | Present | $6 \times 10^{-5}$ | Surface region of 20% | $5 \times 10^{-8}$ | Surface region of 20% |
| M-10 | Cl 99 mol % (Br 1 mol %)* | 0.50μ | 0.06 | cubic | Present | $6 \times 10^{-5}$ | Surface region of 20% | $2 \times 10^{-6}$ | 1% in surface region of 20% and 99% in localized phase |
| M-11 | Cl 99 mol % (Br 1 mol %)* | 0.51μ | 0.07 | cubic | Present | $6 \times 10^{-5}$ | Surface region of 20% | $2 \times 10^{-6}$ | Localized phase |

*Silver bromide localized phases were formed on the surface of silver halide grains of 100% silver chloride.

TABLE 2-2

Blue-Sensitive Emulsion

| Emulsion | Halogen Composition | Grain Size | Variation Coefficient of Grain Size Distribution | Shape of Grain | Silver Bromide Localized Phase | Iron Ions (mol/mol Ag) | Region containing Iron Ions in Grain | Iridium Ions (mol/mol Ag) | Region containing Iridium Ions in Grain |
|---|---|---|---|---|---|---|---|---|---|
| Y-1 | Cl 99 mol % (Br 1 mol %) | 0.79μ | 0.07 | cubic | None | $4 \times 10^{-5}$ | Uniformly contained in grain | $3 \times 10^{-8}$ | Uniformly contained in grain |
| Y-2 | Cl 99 mol % (Br 1 mol %) | 0.78μ | 0.08 | cubic | None | $4 \times 10^{-5}$ | Uniformly contained in grain | $3 \times 10^{-8}$ | Surface region of 20% |
| Y-3 | Cl 99 mol % (Br 1 mol %) | 0.79μ | 0.07 | cubic | None | $4 \times 10^{-5}$ | Surface region of 50% | $3 \times 10^{-8}$ | Sutface region of 20% |
| Y-4 | Cl 99 mol % (Br 1 mol %) | 0.79μ | 0.07 | cubic | None | $4 \times 10^{-5}$ | Surface region of 40% | $3 \times 10^{-8}$ | Surface region of 20% |
| Y-5 | Cl 99 mol % (Br 1 mol %) | 0.79μ | 0.06 | cubic | None | $4 \times 10^{-5}$ | Surface region of 20% | $3 \times 10^{-8}$ | Surface region of 20% |
| Y-6 | Cl 100 mol % | 0.78μ | 0.07 | cubic | None | $4 \times 10^{-5}$ | Surface region of 20% | $3 \times 10^{-8}$ | Surface region of 20% |
| Y-7 | Cl 99 mol % (Br 1 mol %)* | 0.79μ | 0.08 | cubic | Present | $4 \times 10^{-5}$ | Surface region of 20% | $3 \times 10^{-8}$ | Surface region of 20% |
| Y-8 | Cl 99 mol % (Br 1 mol %)* | 0.78μ | 0.07 | cubic | Present | $4 \times 10^{-5}$ | Surface region of 20% | $1 \times 10^{-6}$ | Localized phase |

*Silver bromide localized phases were formed on the surface of silver halide grains of 100% silver chloride.

TABLE 2-3

Red-Sensitive Emulsion

| Emulsion | Halogen Composition | Grain Size | Variation Coefficient of Grain Size Distribution | Shape of Grain | Silver Bromide Localized Phase | Iron Ions (mol/mol Ag) | Region containing Iron Ions in Grain | Iridium Ions (mol/mol Ag) | Region containing Iridium Ions in Grain |
|---|---|---|---|---|---|---|---|---|---|
| C-1 | Cl 99 mol % (Br 1 mol %) | 0.59μ | 0.08 | cubic | None | $1 \times 10^{-4}$ | Uniformly contained in grain | $9 \times 10^{-8}$ | Uniformly contained in grain |
| C-2 | Cl 99 mol % (Br 1 mol %) | 0.58μ | 0.07 | cubic | None | $1 \times 10^{-4}$ | Uniformly contained in grain | $9 \times 10^{-8}$ | Surface region of 20% |
| C-3 | Cl 99 mol % (Br 1 mol %) | 0.56μ | 0.07 | cubic | None | $1 \times 10^{-4}$ | Surface region of 50% | $9 \times 10^{-8}$ | Surface region of 20% |
| C-4 | Cl 99 mol % (Br 1 mol %) | 0.56μ | 0.07 | cubic | None | $1 \times 10^{-4}$ | Surface region of 40% | $9 \times 10^{-8}$ | Surface region of 20% |
| C-5 | Cl 99 mol % (Br 1 mol %) | 0.58μ | 0.07 | cubic | None | $1 \times 10^{-4}$ | Surface region of 20% | $9 \times 10^{-8}$ | Surface region of 20% |
| C-6 | Cl 100 mol % | 0.59μ | 0.08 | cubic | None | $1 \times 10^{-4}$ | Surface region of 20% | $9 \times 10^{-8}$ | Surface region of 20% |
| C-7 | Cl 99 mol % (Br 1 mol %)* | 0.58μ | 0.07 | cubic | Present | $1 \times 10^{-4}$ | Surface region of 20% | $9 \times 10^{-8}$ | Surface region of 20% |
| C-8 | Cl 99 mol % (Br 1 mol %)* | 0.58μ | 0.07 | cubic | Present | $1 \times 10^{-4}$ | Surface region of 20% | $4 \times 10^{-6}$ | Localized phase |

*Silver bromide localized phases were formed on the surface of silver halide grains of 100% silver chloride.

Preparation of Samples 101 to 126

A surface of a paper support laminated with polyethylene on both sides was subjected to a corona discharge treatment. Into the polyethylene laminate layer on the side for providing photographic constituting layers had been incorporated Compound (K-1) and Compound (K-2) shown below in an amount of 3 mg/m$^2$ and 12 mg/m$^2$, respectively. On the surface subjected to the corona discharge treatment was provided a gelatin undercoat layer containing sodium dodecylbenzenesulfonate, and various photographic constituent layers described below were coated thereon to prepare a silver halide multilayer color photographic light-sensitive material designated Sample 101.

Compound (K-1)

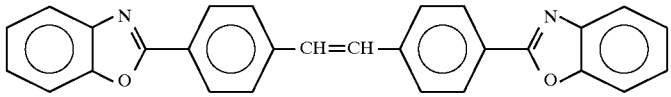

Compound (K-2)

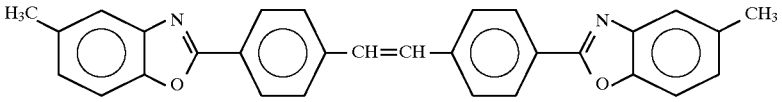

Preparation of Coating Solution for Third Layer 100.0 g of Magenta Coupler (ExM), 18.8 g of Color Image stabilizer (Cpd-2), 62.5 g of Color Image Stabilizer (Cpd-5), 6.3 g of Color Image Stabilizer (Cpd-6), 50.0 g of Color Image Stabilizer (Cpd-7), 6.3 g of Color Image Stabilizer (Cpd-8), and 100.0 g of Ultraviolet Absorber (UV-2) were dissolved in a mixture of 75.0 g of Solvent (Solv-3), 243.8 g of Solvent (Solv-4), 162.5 g of Solvent (Solv-6) and 50 g of ethyl acetate, and the solution was emulsified and dispersed into 600 ml of a 20% aqueous gelatin solution containing 7.0 g of sodium dodecylbenzenesulfonate to prepare Emulsified Dispersion M.

Emulsified Dispersion M was mixed with the green-sensitive silver chlorobromide emulsion designated Emulsion M-1 and the mixture was dissolved to prepare a coating solution for the third layer having the composition described below.

The coating solutions for the first to seventh layers other than the third layer were prepared in the same manner as the coating solution for the third layer. 1-Oxy-3,5-dichloro-s-triazine sodium salt was used as a gelatin hardening agent in each layer.

Further, Cpd-12 and Cpd-13 shown below were added to each layer so that the total coating amount became 25.0 mg/m$^2$ and 50.0 mg/m$^2$, respectively.

Also, the following compound was added to the fifth lager (red-sensitive silver halide emulsion layer) in an amount of 3.5 mg/m$^2$.

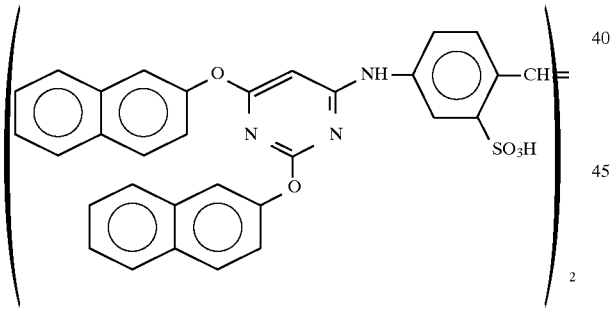

Further, 1-(5-methylureidophenyl)-5-mercapto-tetrazole was added to the blue-sensitive emulsion layer, the green-sensitive emulsion layer and the red-sensitive emulsion layer in an amount of $8.5\times10^{-4}$ mol, $3.0\times10^{-3}$ mol and $2.5\times10^{-4}$ mol, respectively, per mol of the silver halide.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following dyes were added to the sixth layer as irradiation preventing water-soluble dyes.

Yellow Dye

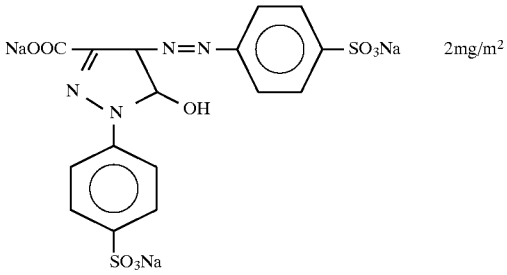

2mg/m$^2$

Magenta Dye

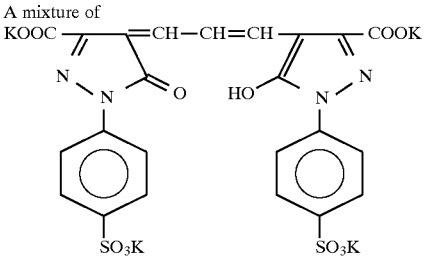

10mg/m$^2$ and

-continued

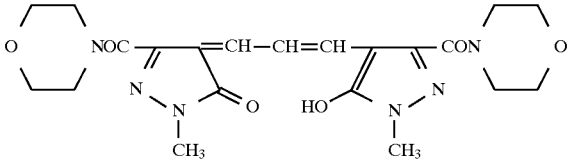

10mg/m²

Cyan Dye

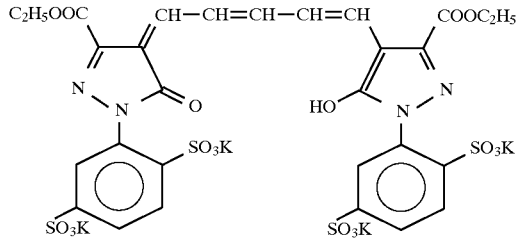

30 mg/m²

Layer Construction

The composition of each layer is described below. The numeral represents the coating amount (g/m²). The numeral for silver halide emulsion represents the coating amount in terms of silver.

Support

Polyethylene-laminated paper containing titanium oxide in an amount of 18 wt %, a bluish dye (ultramarine), Compound (K-1) in an amount of 3 mg/m² and Compound (K-2) in an amount of 12 mg/m² in the polyethylene laminated layer on the side of the first layer.

| | |
|---|---|
| First Layer (blue-sensitive emulsion layer) | |
| Silver Chlorobromide Emulsion Y-1 | 0.27 |
| Gelatin | 1.22 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-5) | 0.01 |
| Solvent (Solv-1) | 0.13 |
| Solvent (Solv-5) | 0.13 |
| Second Layer (color mixing preventing layer) | |
| Gelatin | 0.90 |
| Color Mixing Preventing Agent (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| Third Layer (green-sensitive emulsion layer) | |
| Silver Chlorobromide Emulsion M-1 | 0.14 |
| Gelatin | 1.45 |
| Magenta Coupler (ExM) | 0.16 |
| Ultraviolet Absorber (UV-2) | 0.16 |
| Color Image Stabilizer (Cpd-2) | 0.03 |
| Color Image Stabilizer (Cpd-5) | 0.10 |
| Color Image Stabilizer (Cpd-6) | 0.01 |
| Color Image Stabilizer (Cpd-7) | 0.08 |
| Color Image Stabilizer (Cpd-8) | 0.01 |

-continued

| | |
|---|---|
| Solvent (Solv-3) | 0.13 |
| Solvent (Solv-4) | 0.39 |
| Solvent (Solv-6) | 0.26 |
| Fourth Layer (color mixing preventing layer) | |
| Gelatin | 0.68 |
| Color Mixing Preventing Agent (Cpd-4) | 0.06 |
| Solvent (Solv-1) | 0.07 |
| Solvent (Solv-2) | 0.11 |
| Solvent (Solv-3) | 0.18 |
| Solvent (Solv-8) | 0.02 |
| Fifth Layer (red-sensitive emulsion layer) | |
| Silver Chlorobromide Emulsion C-1 | 0.18 |
| Gelatin | 0.80 |
| Cyan Coupler (ExC) | 0.33 |
| Ultraviolet Absorber (UV-2) | 0.05 |
| Color Image Stabilizer (Cpd-1) | 0.05 |
| Color Image Stabilizer (Cpd-2) | 0.02 |
| Color Image Stabilizer (Cpd-5) | 0.06 |
| Color Image Stabilizer (Cpd-6) | 0.01 |
| Color Image Stabilizer (Cpd-8) | 0.01 |
| Color Image Stabilizer (Cpd-14) | 0.10 |
| Color Image Stabilizer (Cpd-15) | 0.06 |
| Solvent (Solv-1) | 0.15 |
| Solvent (Solv-10) | 0.15 |
| Sixth Layer (ultraviolet absorbinq layer) | |
| Gelatin | 0.48 |
| Ultraviolet Absorber (UV-1) | 0.38 |
| Color Image Stabilizer (Cpd-5) | 0.01 |
| Color Image Stabilizer (Cpd-7) | 0.05 |
| Solvent (Solv-9) | 0.05 |
| Seventh Layer (protective layer) | |
| Gelatin | 0.90 |
| Acryl-Modified Copolymer of Polyvinyl Alcohol (modification degree: 17%) | 0.05 |
| Liquid Paraffin | 0.02 |
| Color Image Stabilizer (Cpd-11) | 0.01 |

The compounds used for preparing the composition of each layer described above are shown below.

(ExY) Yellow Coupler

1/1 mixture by mol ratio of

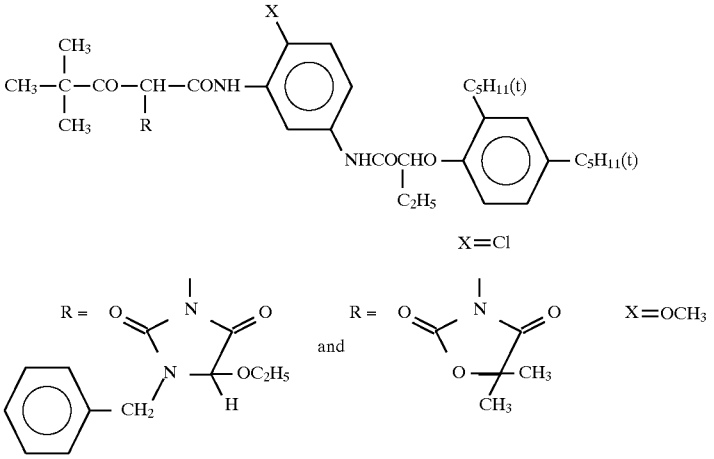
X=Cl
X=$OCH_3$
(ExM) magenta Coupler
1/1 mixture by mol ratio of
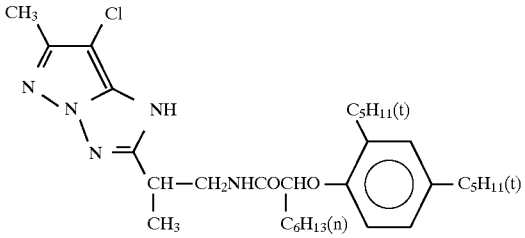
and
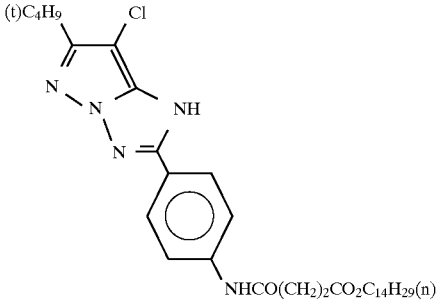
(
(ExC) Cyan Coupler
1/1 mixture by mol ratio of
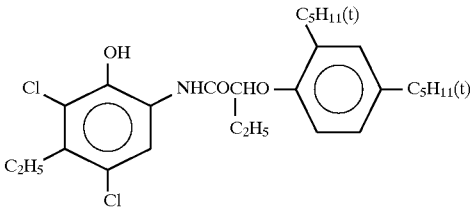
and
-continued
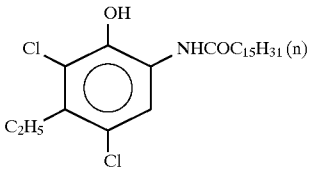
(Cpd-1) Color Image Stabilizer
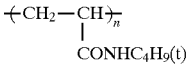
number average molecular weight: 60,000
(Cpd-2) Color Image Stabilizer
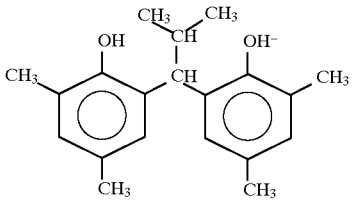
(Cpd-3) Color Image Stabilizer
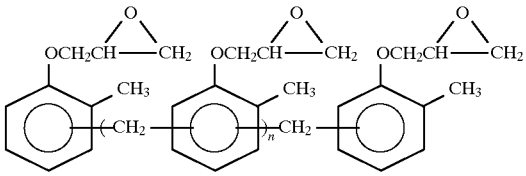

(Cpd-4) Color Mixing Preventing Agent

1/1/1 mixture by weight ratio of

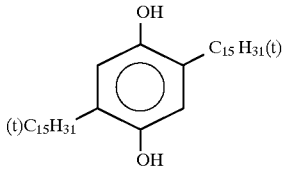

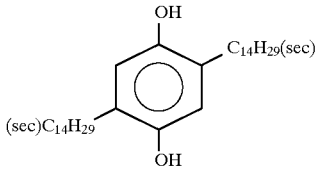

and

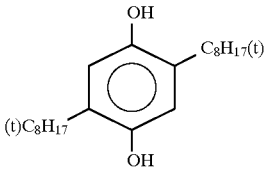

(Cpd-5) Color Image Stabilizer

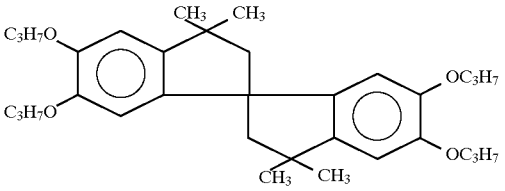

(Cpd-6) Color Image Stabilizer

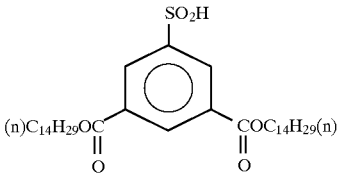

(Cpd-7) Color Image Stablizer

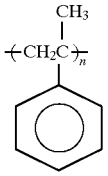

number average molecular weight: 600

(Cpd-8) Color Image Stabilizer

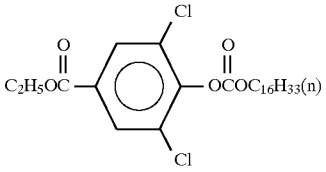

(Cpd-11) Color Image Stabilizer

1/2/1 mixture by weight ratio of i)/ii)/iii)

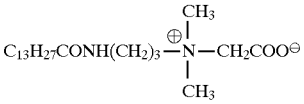

i)

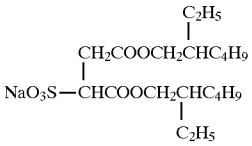

ii)

and

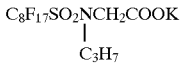

iii)

(Cpd-12) Preservative

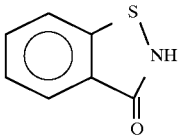

(Cpd-13) Preservative

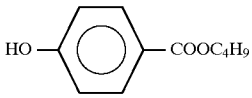

(Cpd-14) Color Image Stabilizer

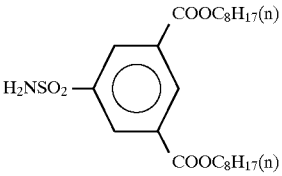

(Cpd-15) Color Image Stabilizer

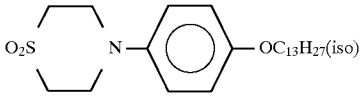

(UV-1) UV Absorber

1/2/2/3/1 mixture by weight ratio of (iv)/(v)/(vi)/(vii)/(viii)

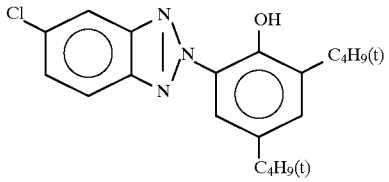
(iv)

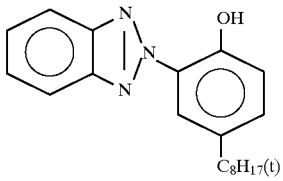
(v)

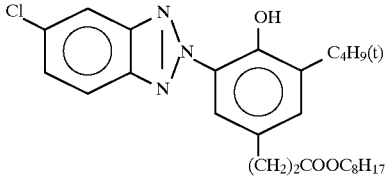
(vi)

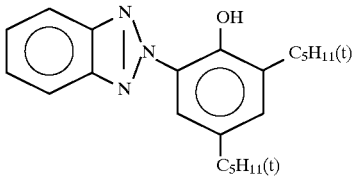
(vii)

and

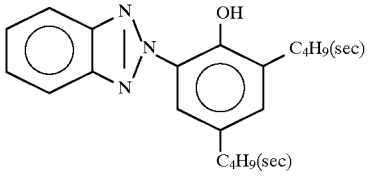
(viii)

(UV-2) UV Absorber

2/3/4/1 mixture by weight ratio of (ix)/(x)/(xi)/(xii)

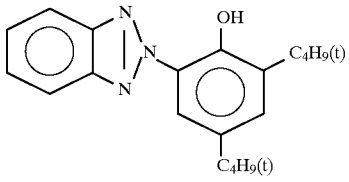
(ix)

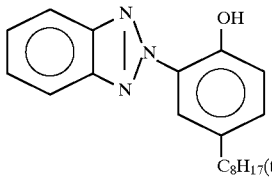
(x)

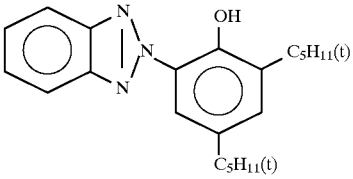
(xi)

-continued

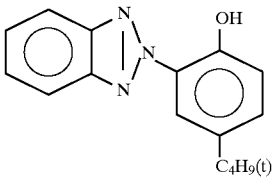
(xii)

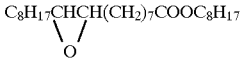
(Solv-1) Solvent

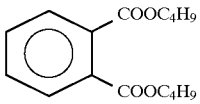
(Solv-2) Solvent

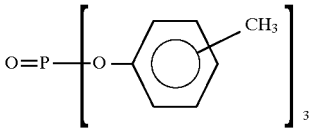
(Solv-3) Solvent

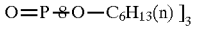
(Solv-4) Solvent

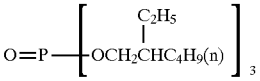
(Solv-5) Solvent

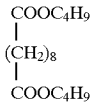
(Solv-6) Solvent

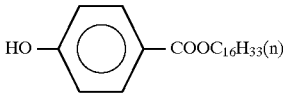
(Solv-8) Solvent

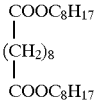
(Solv-9) Solvent

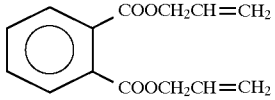
(Solv-10) Solvent

In the same manner as in the preparation of Sample 101 except for changing the silver halide emulsion and/or adding Comparative Compound (I) shown below to Emulsified Dispersion M and/or adding Comparative Compound (II) shown below or Compounds (I)-1, (I)-3, (I)-5, (I)-7, (I)-9 or (I)-10 according to the present invention to the sixth layer as shown below to prepare Samples 102 to 126.

Comparative Compound (I)

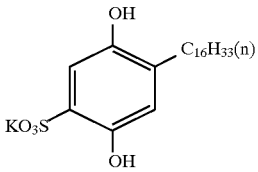

Comparative Compound (II)

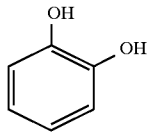

The silver halide emulsions used and the amounts of various compounds added in the preparation of Samples 101 to 126 are described in Table 3 below.

TABLE 3

| Sample | Blue-Sensitive Emulsion | Green-Sensitive Emulsion | Red-Sensitive Emulsion | Compound | Amount Added ($g/m^2$) | Remarks |
|---|---|---|---|---|---|---|
| 101 | Y-1 | M-1 | C-1 | — | — | Comparative Example |
| 102 | Y-1 | M-2 | C-1 | — | — | Comparative Example |
| 103 | Y-2 | M-3 | C-2 | — | — | Comparative Example |
| 104 | Y-3 | M-4 | C-3 | — | — | Comparative Example |
| 105 | Y-3 | M-4 | C-3 | Comparative Compound (I) | $2 \times 10^{-2}$ | Comparative Example |
| 106 | Y-3 | M-4 | C-3 | Comparative Compound (II) | $2 \times 10^{-2}$ | Comparative Example |
| 107 | Y-3 | M-4 | C-3 | (I)-5 | $2 \times 10^{-2}$ | Present Invention |
| 108 | Y-3 | M-5 | C-3 | — | — | Comparative Example |
| 109 | Y-3 | M-5 | C-3 | (I)-5 | $2 \times 10^{-2}$ | Present invention |
| 110 | Y-4 | M-6 | C-4 | — | — | Comparative Example |
| 111 | Y-4 | M-6 | C-4 | (I)-5 | $2 \times 10^{-2}$ | Present invention |
| 112 | Y-5 | M-7 | C-5 | — | — | Comparative Example |
| 113 | Y-5 | M-7 | C-5 | (I)-5 | $2 \times 10^{-2}$ | Present invention |
| 114 | Y-6 | M-8 | C-6 | (I)-5 | $2 \times 10^{-2}$ | Present invention |
| 115 | Y-7 | M-9 | C-7 | (I)-5 | $2 \times 10^{-2}$ | Present invention |
| 116 | Y-7 | M-10 | C-7 | (I)-5 | $2 \times 10^{-2}$ | Present invention |
| 117 | Y-8 | M-11 | C-8 | — | — | Comparative Example |
| 118 | Y-8 | M-11 | C-8 | (I)-5 | $7 \times 10^{-5}$ | Present invention |
| 119 | Y-8 | M-11 | C-8 | (I)-5 | $1 \times 10^{-4}$ | Present invention |
| 120 | Y-8 | M-11 | C-8 | (I)-5 | $2 \times 10^{-2}$ | Present invention |
| 121 | Y-8 | M-11 | C-8 | (I)-5 | $2 \times 10^{-1}$ | Present invention |
| 122 | Y-8 | M-11 | C-8 | (I)-1 | $2 \times 10^{-2}$ | Present invention |
| 123 | Y-8 | M-11 | C-8 | (I)-3 | $2 \times 10^{-2}$ | Present invention |
| 124 | Y-8 | M-11 | C-8 | (I)-7 | $2 \times 10^{-2}$ | Present invention |
| 125 | Y-8 | M-11 | C-8 | (I)-9 | $2 \times 10^{-2}$ | Present invention |
| 126 | Y-8 | M-11 | C-8 | (I)-10 | $2 \times 10^{-2}$ | Present invention |

Samples 101 to 126 thus-obtained were stored for one week under normal temperature and humidity conditions and then subjected to exposure to light and development processing in the following manner.

Each of the samples was subjected to gradation exposure for sensitometry in the exposure amount of 250 CMS for 1 second using a sensitometer (FWH Model, color temperature of light source: 3200° K manufactured by Fuji Photo Film Co., Ltd.) through a blue filter, a green filter or a red filter, and then development processing described below. Color density measurement of the thus-processed sample was conducted and sensitometric results corresponding to the blue-, green- and red-sensitive emulsion layers were obtained.

On the other hand, high-illumination short exposure was conducted using a scanning exposure device shown in FIG. 1 of JP-A-8-16238. An exposure part of the scanning exposure device is described in detail below. A light source of 688 nm (R light) was obtained using a semiconductor laser. A light source of 532 nm (G light) and a light source of 473 nm (B light) were obtained by combining a semiconductor laser with SHG respectively. The laser rays each having a different wavelength were modulated using an external modulator to vary the quantity of light, reflected on a rotary polyhedron, and successively applied to the sample for the scanning exposure, which were being moved in the direction vertical to the scanning direction. The scanning exposure was effected at 400 dpi, and the mean exposure time was about $8\times10^{-8}$ second per one pixel. Using a Peltier device, the temperatures of the semiconductor lasers were kept constant in order to prevent the temperature-dependent fluctuation of the quantity of light from each laser.

Each of the samples was subjected to the scanning exposure which varying the quantity of each of the B, G and R light and then development processing described below. Color density measurement of the thus-processed sample was conducted and sensitometric results corresponding to the high-illumination short exposure to the blue-, green- and red-sensitive emulsion layers were obtained.

Further, each of the samples was subjected to uniform gray exposure so as to render color densities of B, G and R each 0.5 using a printer for flooding exposure (Fuji Color Roll Printer 8C6910 manufactured by Fuji Photo Film Co., Ltd.) and the scanning exposure device described above. The gray exposure was successively conducted in a cabinet size. A transportation speed of the sample at the scanning exposure was 80 mm/sec. The exposed sample was subjected to development processing described below to prepare a sample for visually evaluating pressure resistivity.

| Processing Step | Processing Temperature (°C.) | Processing Time (sec) | Replenishment Rate* (ml) | Tank Capacity (ml) |
|---|---|---|---|---|
| Color Development | 38.5 | 45 | 120 | 500 |
| Bleach-Fixing | 30–35 | 45 | | |
| Rinsing (1) | 30–35 | 20 | | |
| Rinsing (2) | 30–35 | | | |
| Rinsing (3) | 30–35 | 20 | | |
| Drying | 70–80 | 60 | | |

*Replenishment rate per $m^2$ of the photographic material

Rinsing was conducted in a 3-tank countercurrent system from rinsing (3) to rinsing (1).

The composition of each processing solution was as follows.

| Color Developinq Solution | Tank Solution | Replenisher |
|---|---|---|
| Water | 700 ml | 700 ml |
| Sodium Triisopropylene(β)-sulfonate | 0.1 g | 0.1 g |
| Ethylenediaminetetraacetic Acid | 2.5 g | 3.0 g |
| Disodium 1,2-dihydroxybenzene-4,6-disulfonate | 0.5 g | 0.5 g |
| Triethanolamine | 9.0 g | 12.0 g |
| Potassium Chloride | 5.0 g | — |
| Potassium Bromide | 0.02 g | — |
| Potassium Carbonate | 27.0 g | 27.0 g |
| Brightening Agent (WHITEX 4, manufactured by Sumitomo Chemical Co., Ltd.) | 1.0 g | 3.0 g |
| Sodium Sulfite | 0.1 g | 0.1 g |
| Disodium-N,N-bis(sulfonato-ethyl)hydroxylamine | 8.5 g | 11.0 g |
| N-Ethyl-N-(β-methanesulfon-amidoethyl)-3-methyl-4-amino-aniline Sulfate | 5.0 g | 9.5 g |
| Water to make | 1,000 ml | 1,000 ml |
| pH (25° C.) | 10.0 | 11.0 |

Bleach-Fixing Solution (tank solution and replenisher are the same)

| | |
|---|---|
| Water | 600 ml |
| Ammonium Thiosulfate (700 g/liter) | 100 ml |
| Sodium Sulfite | 30 g |
| Ammonium Ethylenediaminetetraacetato Ferrate | 55 g |
| Disodium Ethylenediaminetetraacetate | 5 g |
| Ammonium Bromide | 40 g |
| Nitric Acid (67%) | 30 g |
| Water to make | 1,000 ml |
| pH (25° C.) (adjusted with acetic acid and aqueous ammonia) | 5.8 |

Rinsing Solution (tank solution and replenisher are the same)

Ion Exchange Water (each concentration of calcium and magnesium is 3 ppm or less)

The exposure amount required to produce a density of 0.5 above the fog level was determined from the sensitometric curve corresponding to each of the blue-, green- and red-sensitive emulsions and the reciprocal of the exposure amount was calculated. The value obtained with Sample 101 was taken as 100 and sensitivities (S) in case of the conventional flooding exposure and sensitivities (S') in case of the high-illumination scanning exposure were obtained relatively.

Also, a color density corresponding to the exposure amount 10 times larger than the exposure amount required to produce a density of 0.5 above the fog level was determined from the sensitometric curve. The color density obtained by the flooding exposure was designated color density (D) and the color density obtained by the high-illumination scanning exposure was designated color density (D'). A ratio of these color densities (D'/D) was employed as an index to evaluate the high-illumination exposure suitability. When the value is 1, the hard gradation same as that obtained by the flooding exposure is obtained by the high-illumination exposure. As the value moves from 1 to 0, soft gradation enhancement proceeds in the high-illumination exposure as compared with the flooding exposure.

Further, ten cabinet-size sheets of each sample subjected to the gray exposure and color development processing as above were visually observed and the occurrence of sensitization streaks due to pressure caused by rollers for transporting the photographic materials at the scanning exposure was determined to evaluate the pressure resistivity in the following manner.

A: Sensitization streaks due to pressure were not observed.

B: Slight sensitization streaks due to pressure were observed in one or two sheets among the ten sheets.

C: Slight sensitization streaks due to pressure were observed in three to ten sheets among the ten sheets.

D: Distinct sensitization streaks due to pressure were observed in one or two sheets among the ten sheets.

E: Distinct sensitization streaks due to pressure were observed in three to five sheets among the ten sheets.

F: Distinct sensitization streaks due to pressure were observed in six to ten sheets among the ten sheets.

Further, in order to investigate the photographic characteristics after the storage for a long period of time, each of the unexposed samples was stored under the condition of 35° C. and 40% RH for one month (corresponding to a forced aging test) and then the various properties were evaluated in the same manner as above.

Specifically, the difference between the sensitivity obtained after the storage for a long time and that obtained before the storage was determined and denoted as ΔS in case of the flooding exposure and as ΔS' in case of the high-illumination scanning exposure for the purpose of evaluating the change in the sensitivity after the storage. When the value is 0, there is no change in the sensitivity. As the value increases, the rise of the sensitivity after the storage becomes large.

The results of the evaluation of various properties as described above are collectively shown in Table 4 below.

TABLE 4

| | B | | | | | G | | | | | R | | | | | Evaluation of Pressure Resistivity | | | |
|---|---|---|---|---|---|---|---|---|---|---|---|---|---|---|---|---|---|---|---|
| | | | | | | | | | | | | | | | | Flooding Exposure | | Scanning Exposure | |
| Sample | S | S' | D'/D | ΔS | ΔS' | S | S' | D'/D | ΔS | ΔS' | S | S' | D'/D | ΔS | ΔS' | Before Storage | After Storage | Before Storage | After Storage |
| 101 | 100 | 100 | 0.85 | 10 | 11 | 100 | 100 | 0.79 | 6 | 8 | 100 | 100 | 0.75 | 2 | 3 | A*1 | B | A*1 | B |
| 102 | 99 | 100 | 0.84 | 10 | 10 | 99 | 100 | 0.80 | 7 | 7 | 99 | 99 | 0.77 | 3 | 2 | A*1 | B | A*1 | B |
| 103 | 100 | 101 | 0.86 | 11 | 12 | 101 | 101 | 0.80 | 8 | 9 | 101 | 100 | 0.75 | 3 | 4 | A*1 | B | A*1 | B |
| 104 | 103 | 110 | 0.92 | 17 | 20 | 103 | 110 | 0.89 | 14 | 15 | 101 | 112 | 0.88 | 8 | 8 | A*2 | C | A*2 | C |
| 105 | 102 | 109 | 0.90 | 17 | 20 | 102 | 109 | 0.90 | 15 | 15 | 101 | 113 | 0.90 | 9 | 9 | A*2 | C | A*1 | C |
| 106 | 102 | 107 | 0.91 | 21 | 24 | 101 | 108 | 0.89 | 20 | 22 | 103 | 115 | 0.88 | 9 | 8 | A*2 | C | A*2 | C |
| 107 | 103 | 110 | 0.90 | 9 | 9 | 103 | 110 | 0.89 | 6 | 7 | 104 | 114 | 0.90 | 4 | 4 | A*2 | A | A*2 | A |
| 108 | 105 | 118 | 0.93 | 22 | 28 | 104 | 116 | 0.91 | 18 | 19 | 102 | 112 | 0.92 | 14 | 13 | A | C | A | C |
| 109 | 104 | 119 | 0.93 | 9 | 10 | 105 | 117 | 0.92 | 5 | 6 | 103 | 114 | 0.91 | 3 | 4 | A | A | A | A |
| 110 | 105 | 121 | 0.95 | 22 | 30 | 104 | 121 | 0.94 | 20 | 21 | 103 | 118 | 0.94 | 15 | 15 | A | C | A | C |
| 111 | 106 | 122 | 0.94 | 10 | 10 | 104 | 120 | 0.94 | 5 | 6 | 103 | 117 | 0.94 | 4 | 4 | A | A | A | A |
| 112 | 108 | 129 | 0.97 | 25 | 35 | 106 | 125 | 0.97 | 23 | 23 | 103 | 120 | 0.96 | 17 | 18 | A | C | A | C |
| 113 | 107 | 130 | 0.96 | 8 | 10 | 108 | 127 | 0.96 | 5 | 6 | 104 | 119 | 0.97 | 3 | 3 | A | A | A | A |
| 114 | 102 | 115 | 0.94 | 7 | 9 | 105 | 119 | 0.95 | 7 | 7 | 97 | 108 | 0.94 | 1 | 0 | A | A | A | A |
| 115 | 108 | 134 | 0.97 | 8 | 9 | 110 | 132 | 0.98 | 5 | 5 | 110 | 123 | 0.99 | 2 | 4 | A | A | A | A |
| 116 | 109 | 134 | 0.97 | 6 | 9 | 110 | 134 | 0.96 | 5 | 5 | 109 | 122 | 0.98 | 2 | 3 | A | A | A | A |
| 117 | 110 | 133 | 1.00 | 27 | 35 | 109 | 135 | 0.99 | 25 | 25 | 110 | 122 | 0.99 | 19 | 20 | A | D | A | D |
| 118 | 111 | 132 | 1.00 | 18 | 18 | 110 | 133 | 1.00 | 13 | 12 | 111 | 124 | 0.98 | 10 | 10 | A | B | A | B |
| 119 | 110 | 134 | 0.99 | 11 | 12 | 110 | 136 | 0.99 | 9 | 9 | 110 | 122 | 0.99 | 3 | 4 | A | A | A | A |
| 120 | 109 | 133 | 1.00 | 6 | 8 | 110 | 135 | 1.00 | 5 | 6 | 109 | 124 | 0.99 | 2 | 2 | A | A | A | A |
| 121 | 109 | 128 | 0.99 | 5 | 8 | 108 | 132 | 0.97 | 5 | 5 | 110 | 123 | 0.99 | 3 | 2 | A | A | A | A |
| 122 | 110 | 128 | 0.99 | 9 | 11 | 109 | 130 | 0.99 | 10 | 11 | 109 | 124 | 0.98 | 8 | 9 | A | A | A | A |
| 123 | 107 | 120 | 0.96 | 12 | 14 | 108 | 122 | 0.96 | 11 | 14 | 111 | 122 | 0.95 | 12 | 11 | A | A | A | A |
| 124 | 107 | 118 | 0.94 | 15 | 18 | 108 | 120 | 0.94 | 12 | 18 | 108 | 122 | 0.93 | 14 | 12 | A | B | A | B |
| 125 | 107 | 122 | 0.98 | 11 | 12 | 109 | 124 | 0.97 | 9 | 13 | 108 | 121 | 0.97 | 10 | 9 | A | B | A | B |
| 126 | 107 | 118 | 0.96 | 16 | 20 | 108 | 119 | 0.96 | 15 | 18 | 110 | 123 | 0.94 | 13 | 14 | A | B | A | B |

*1 Desensitization streaks due to pressure were observed in six to ten sheets among the ten sheets.
*2 Desensitization streaks due to pressure were observed in one to five sheets among the ten sheets.

From the comparison of the results of Samples 101 to 104, 108, 110, 112 and 117 shown in Table 4, it can be seen that the almost same properties are obtained whether iridium ions are uniformly present in the silver halide grains or they are concentrated in the surface region of the silver halide grains. On the other hand, when iron ions are concentratedly incorporated into the surface region of the silver halide grains, the pressure-induced desensitization is little and high sensitivity is maintained. However, at the same time, the problems of the increase in sensitivity during the preservation for a long period of time and of the pressure-induced sensitization after the preservation for a long period of time occur. These problems can be solved by incorporating the compound according to the present invention into the silver halide photographic material, although the incorporation of the comparative compound into the silver halide photographic material is ineffective on the problems as shown in the results of Samples 105 to 126.

EXAMPLE 2

Using the samples described in Example 1, the gray exposure was conducted in the same manner as in Example 1 except that the transportation of the sample was stopped each time after the exposure of one sheet of cabinet size and then, the sample was transported 30 mm in the reverse direction.

After the gray exposure, the samples were subjected to the color development processing and the evaluation of the pressure resistivity in the same manner as in Example 1. Further, with the samples stored for a long time in the same manner as in Example 1, the exposure, color development processing and evaluation were performed in the same manner as above.

The results obtained are shown in Table 5 below.

TABLE 5

| | Evaluation of Pressure Resistivity | |
|---|---|---|
| Sample | Before Storage | After Storage |
| 101 | A*1 | B |
| 102 | A*1 | B |
| 103 | A*1 | B |
| 104 | A*2 | D |

TABLE 5-continued

| Sample | Evaluation of Pressure Resistivity Before Storage | After Storage |
|---|---|---|
| 105 | A*2 | D |
| 106 | A*2 | E |
| 107 | A*2 | A |
| 108 | A | D |
| 109 | A | A |
| 110 | A | D |
| 111 | A | A |
| 112 | A | E |
| 113 | A | A |
| 114 | A | B |
| 115 | A | A |
| 116 | A | A |
| 117 | A | E |
| 118 | A | B |
| 119 | A | B |
| 120 | A | A |
| 121 | A | A |
| 122 | A | B |
| 123 | A | B |
| 124 | A | B |
| 125 | A | B |
| 126 | A | B |

*1Desensitization streaks due to pressure were observed in six to ten sheets among the ten sheets.
*2Desensitization streaks due to pressure were observed in one to five sheets among the ten sheets.

From the comparison of the results of Samples 101 to 104, 108, 110, 112 and 117 shown in Table 4 and Table 5, it can be seen that the undesirable pressure-induced sensitization is further increased when the reverse transportation of the sample stored for a long time was conducted in the scanning exposure process in order to prevent the occurrence of loss in the silver halide photographic material.

The increase in the undesirable pressure-induced sensitization resulting from the reverse transportation of the sample stored for a long time can be prevented only by using the compound according to the present invention as shown in the results of Samples 105 to 126.

EXAMPLE 3

The same procedures as in the preparation of Emulsions M-1 to M-11, Y-1 to Y-8 and C-1 to C-8 in Example 1 were repeated except for conducting the optimal chemical sensitization using a sulfur sensitizer (triethyl thiourea) and a gold sensitizer (chloroauric acid) in place of using triethyl thiourea to prepare Emulsions M-12 to M-22, Y-9 to Y-16 and C-9 to C-16, respectively.

Samples 301 to 326 were prepared in the same manner as in Samples 101 to 126 expect for using Emulsions M-12 to M-22, Y-9 to Y-16 and C-9 to C-16 in place of Emulsions M-1 to M-11, Y-1 to Y-8 and C-1 to C-8, respectively. Using these samples, the same evaluation as in Examples 1 and 2 was conducted. The excellent effects of the present invention were again obtained.

While the invention has been described in detail and with reference to specific embodiment thereof, it will be apparent to one skilled in the art that various changes and modifications can be made therein without departing from the spirit and scope thereof.

What is claimed is:

1. A silver halide color photographic light-sensitive material comprising a support having thereon at least one silver halide emulsion layer containing a yellow coupler, at least one silver halide emulsion layer containing a magenta coupler and at least one silver halide emulsion layer containing a cyan coupler, wherein at least one of the silver halide emulsion layers contains (1) silver halide grains having a silver chloride content of 95 mol % or more and containing from $1\times10^{-7}$ to $1\times10^{-3}$ mol of iron ion per mol of the silver halide in a state wherein the concentration of iron ion which is present in a surface region of the silver halide grains which amounts to 50% or less of the grain volume is ten times or more as high as that of other region, and (2) a water-soluble compound represented by the following formula (I):

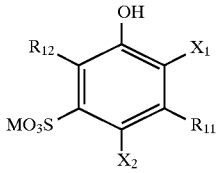

(I)

wherein $X_1$ and $X_2$, which may be the same or different, each represents a hydrogen atom, a hydroxyl group, a halogen atom, a sulfonic acid group or a salt thereof, a carboxylic acid group or a salt thereof, —$NR_{13}R_{14}$ or —$NHSO_2R_{15}$, provided that at least one of $X_1$ and $X_2$ is a hydroxyl group; $R_{11}$ and $R_{12}$, which may be the same or different, each represents a hydrogen atom or a substituent; M represents a hydrogen atom or a monovalent alkali metal; $R_{13}$ and $R_{14}$, which may be the same or different, each represents a hydrogen atom, an alkyl group, an aryl group or a heterocyclic group, or $R_{13}$ and $R_{14}$ may combine with each other to form a heterocyclic ring; and $R_{15}$ represents an alkyl group, an aryl group, an amino group or a heterocyclic group.

2. A silver halide color photographic light-sensitive material as claimed in claim 1, wherein $X_1$ is a hydroxyl group.

3. A silver halide color photographic light-sensitive material as claimed in claim 2, wherein $X_2$ is a hydrogen atom, —$NR_{13}R_{14}$ or —$NHSO_2R_{15}$.

4. A silver halide color photographic light-sensitive material as claimed in claim 1, wherein $X_2$ is a hydroxyl group and $X_1$ is a hydrogen atom, a sulfonic acid group or a salt thereof, or a carboxylic acid or a salt thereof.

5. A silver halide color photographic light-sensitive material as claimed in claim 1, wherein $R_{11}$ and $R_{12}$ each is a hydrogen atom, a sulfonic acid group or a salt thereof, a carboxylic acid or salt thereof, an alkyl group, an aryl group, an alkoxy group, an aryloxy group, or an amino group.

6. A silver halide color photographic light-sensitive material as claimed in claim 1, wherein $R_{11}$ is a sulfonic acid group or a salt thereof.

7. A silver halide color photographic light-sensitive material as claimed in claim 1, wherein the water-soluble compound represented by the formula (I) is soluble not less than 0.1 g per 100 ml of water at 25° C.

8. A silver halide color photographic light-sensitive material as claimed in claim 1, wherein an amount of the water-soluble compound represented by the formula (I) is in a range of from $1\times10^{-5}$ g/m$^2$ to 1 g/m$^2$.

9. A silver halide color photographic light-sensitive material as claimed in claim 1, wherein silver halide grains in all of the light-sensitive silver halide emulsion layers are silver chloride or silver chlorobromide grains having a silver chloride content of 95% or more.

10. A silver halide color photographic light-sensitive material as claimed in claim 1, wherein the iron ion is incorporated into the silver halide grains by adding a water-soluble iron compound in the step of forming the silver halide grains.

11. A silver halide color photographic light-sensitive material as claimed in claim 1, wherein the silver halide emulsion is subjected to gold sensitization.

12. A method of forming a color image comprising subjecting the silver halide color photographic light-sensitive material as claimed in claim 1 to scanning exposure and then to color development, wherein the method contains the following steps (1) and (2);

step (1): transporting the light-sensitive material in the sub-direction of scanning exposure when it is scanning-exposed, and step (2): transporting the light-sensitive material in the direction opposite to step (1) before the color development.

* * * * *